US009051936B2

(12) United States Patent
Kallesøe et al.

(10) Patent No.: US 9,051,936 B2
(45) Date of Patent: Jun. 9, 2015

(54) METHOD FOR OPTIMIZING THE ENERGY OF PUMPS

(75) Inventors: Carsten Skovmose Kallesøe, Viborg (DK); Claudio De Persis, Veroli (IT)

(73) Assignee: Grundfos Management a/s, Bjerringbro (DK)

( * ) Notice: Subject to any disclaimer, the term of this patent is extended or adjusted under 35 U.S.C. 154(b) by 355 days.

(21) Appl. No.: 13/522,640

(22) PCT Filed: Jan. 18, 2011

(86) PCT No.: PCT/EP2011/000184

§ 371 (c)(1),
(2), (4) Date: Oct. 8, 2012

(87) PCT Pub. No.: WO2011/088983

PCT Pub. Date: Jul. 28, 2011

(65) Prior Publication Data

US 2013/0017098 A1 Jan. 17, 2013

(30) Foreign Application Priority Data

Jan. 19, 2010 (EP) ..... 10000447

(51) Int. Cl.
*F04D 13/14* (2006.01)
*F04D 15/00* (2006.01)
*F04D 13/06* (2006.01)

(52) U.S. Cl.
CPC ..... *F04D 13/14* (2013.01); *F04D 15/0066* (2013.01); *F05B 2270/101* (2013.01); *F05B 2270/105* (2013.01); *F05B 2270/111* (2013.01); *F05B 2270/309* (2013.01); *F05B 2270/504* (2013.01); *F04D 13/0686* (2013.01)

(58) Field of Classification Search
CPC . F04D 13/14; F04D 13/0686; F04D 15/0066; F05B 2270/101; F05B 2270/309; F05B 2270/111; F05B 2270/504; F05B 2270/105
USPC ..... 417/3, 4, 5, 7, 44.11, 45
See application file for complete search history.

(56) References Cited

U.S. PATENT DOCUMENTS

2005/0110655 A1 5/2005 Layton
2009/0283457 A1 11/2009 Buchanan et al.

FOREIGN PATENT DOCUMENTS

DE 102004041661 * 3/2006 ..... F04B 41/06
DE 102004041661 A1 3/2006
EP 1 209 364 A2 5/2002
EP 1462652 A2 9/2004
GB 2010959 A 7/1979
WO 2009020402 A1 2/2009

OTHER PUBLICATIONS

Int'l Search Report issued May 11, 2011 in Int'l Application No. PCT/EP2011/000184.

* cited by examiner

*Primary Examiner* — Bryan Lettman
(74) *Attorney, Agent, or Firm* — Panitch Schwarze Belisario & Nadel LLP

(57) ABSTRACT

The device for energy-optimization on operation of several centrifugal pumps controlled in rotational speed, in a hydraulic installation, begins firstly with determining which pumps as pilot pumps are assigned directly to a consumer and which pumps are hydraulically connected in series upstream of the pilot pumps. Thereafter, one or more energy-optimization circuits are formed, which in each case consist of one or more pilot pumps and of one or more pumps connected in series upstream, which deliver into the pilot pumps, wherein the energy-optimization circuits are selected such that the pumps connected in series upstream in each case are assigned to only one energy-optimization circuit, whereupon the energy-optimization circuits are energy-optimized with respect to the pumps.

12 Claims, 9 Drawing Sheets a b

| | s1 | s3 | s6 | s7 | s10 | s11 |
|---|---|---|---|---|---|---|
| pu1 | 1 | -1 | -1 | -1 | -1 | 0 |
| pu2 | 1 | -1 | -1 | -1 | -1 | 0 |
| pu3 | -1 | 1 | -1 | -1 | -1 | 0 |
| pu4 | 1 | 1 | -1 | -1 | -1 | 0 |
| pu5 | 1 | 1 | -1 | -1 | -1 | 0 |
| pu6 | -1 | -1 | 1 | -1 | -1 | 0 |
| pu7 | -1 | -1 | -1 | 1 | -1 | 0 |
| pu8 | 1 | 1 | 1 | 1 | -1 | 0 |
| pu9 | 1 | 1 | 1 | 1 | -1 | 0 |
| pu10 | -1 | -1 | -1 | -1 | 1 | 0 |
| pu11 | 0 | 0 | 0 | 0 | 0 | 1 |

a
b
pu1
pu2
pu3
pu4
up
Δh1ref
Δh1
ω1
Δh2
Δh2ref
ω2
Δh3
Δh3ref
ω3
Δh4ref
Δh4
ω4
time a
b
pu1
pu2
pu3
pu4
up
Δh1ref
ω1
Δh2ref
ω2
Δh3ref
ω3
Δh4ref
ω4
time a
b
pu1
pu2
pu3
ω1
q1
ω2
q2
ω3
q3
time a
b
pu1
pu2
pu3
ω1
q1
ω2
q2
ω3
q3
time

| | $q_{11}$ | $q_{10}$ | $q_7$ | $q_6$ | $q_1$ | $q_2$ | $q_3$ | $q_4$ | $q_5$ | $q_8$ | $q_9$ |
|---|---|---|---|---|---|---|---|---|---|---|---|
| pu11 | 1 | 0 | 0 | 0 | 0 | 0 | 0 | 0 | 0 | 0 | 0 |
| pu10 | 0 | 1 | -1 | -1 | -1 | -1 | -1 | -1 | -1 | -1 | -1 |
| pu7 | 0 | -1 | 1 | -1 | -1 | -1 | -1 | -1 | -1 | 1 | 1 |
| pu6 | 0 | -1 | -1 | 1 | -1 | -1 | -1 | -1 | -1 | 1 | 1 |
| pu1 | 0 | -1 | -1 | -1 | 1 | -1 | -1 | 1 | 1 | 1 | 1 |
| pu2 | 0 | -1 | -1 | -1 | -1 | 1 | 1 | 1 | 1 | 1 | 1 |
| pu3 | 0 | -1 | -1 | -1 | -1 | -1 | 1 | 1 | 1 | 1 | 1 |
| pu4 | 0 | -1 | -1 | -1 | 1 | 1 | 1 | 1 | 1 | 1 | 1 |
| pu5 | 0 | -1 | -1 | -1 | 1 | 1 | 1 | 1 | 1 | 1 | 1 |
| pu8 | 0 | -1 | 1 | 1 | 1 | 1 | 1 | 1 | 1 | 1 | -1 |
| pu9 | 0 | -1 | 1 | 1 | 1 | 1 | 1 | 1 | 1 | -1 | 1 |

D

| | $s_{11}$ | $s_{10}$ | $s_7$ | $s_6$ | $s_1$ | $s_2$ | $s_3$ | $s_4$ | $s_5$ | $s_8$ | $s_9$ |
|---|---|---|---|---|---|---|---|---|---|---|---|
| pu11 | 1 | 0 | 0 | 0 | 0 | 0 | 0 | 0 | 0 | 0 | 0 |
| pu10 | 0 | 1 | 1 | 1 | 1 | 1 | 1 | 1 | 1 | 1 | 1 |
| pu7 | 0 | 1 | 1 | 1 | 1 | 1 | 1 | 1 | 1 | -1 | -1 |
| pu6 | 0 | 1 | 1 | 1 | 1 | 1 | 1 | 1 | 1 | -1 | -1 |
| pu1 | 0 | 1 | 1 | 1 | 1 | 1 | 1 | -1 | -1 | -1 | -1 |
| pu2 | 0 | 1 | 1 | 1 | 1 | 1 | 1 | -1 | -1 | -1 | -1 |
| pu3 | 0 | 1 | 1 | 1 | 1 | 1 | 1 | -1 | -1 | -1 | -1 |
| pu4 | 0 | 1 | 1 | 1 | -1 | -1 | -1 | 1 | 1 | -1 | -1 |
| pu5 | 0 | 1 | 1 | 1 | -1 | -1 | -1 | -1 | -1 | 1 | 1 |
| pu8 | 0 | 1 | -1 | -1 | -1 | -1 | -1 | -1 | -1 | 1 | 1 |
| pu9 | 0 | 1 | -1 | -1 | -1 | -1 | -1 | -1 | -1 | 1 | 1 |

METHOD FOR OPTIMIZING THE ENERGY OF PUMPS

CROSS-REFERENCE TO RELATED APPLICATIONS

This application is a Section 371 of International Application No. PCT/EP2011/000184, filed Jan. 18, 2011, which was published in the German language on Jul. 28, 2011, under International Publication No. WO 2011/088983 A1 and the disclosure of which is incorporated herein by reference.

BACKGROUND OF THE INVENTION

Embodiments of the invention relate to a method for the energy-optimization on operation of several centrifugal pumps controllable with regard to their rotational speed, in a hydraulic installation.

A multitude of pumps, i.e. centrifugal pumps with an electric motor driving this, are particularly installed in heating installations of large buildings or those of a more complex construction type, in order to supply the individual installation parts reliably with fluid or heat. Modern pumps of this type are rotational speed controllable, i.e. they have a frequency converter or rotational speed controller as well as suitable control and regulation electronics, with which they may supply a large range of hydraulic demands with regard to power. If a multitude of such pumps cooperate in an installation, be it by way of parallel connection, series connection or a combination thereof, then a complex hydraulic network results, from which is often quite difficult to recognise which function is for which pump. Of course, it is even more difficult to operate these pumps such that, as a sum, they run even only approximately in an energy-optimized manner.

Against this background, it is desirable to provide a method for energy-optimization of the pumps of such a hydraulic installation, without the performance capability of the installation, in particular the supply of all installation parts, becoming adversely affected.

BRIEF SUMMARY OF THE INVENTION

The method according to an embodiment of the invention for energy-optimization on operation of several speed-controllable centrifugal pumps in a hydraulic installation e.g. a heating installation, a water table reduction installation, an irrigation installation, a waste-water installation and likewise, is based on firstly once determining which pumps as pilot pumps are directly assigned to a consumer and which pumps are subordinate to the pilot pumps, whereupon the subordinate pumps are activated with varying speeds for energy-optimization.

The basic concept of the method is thus firstly once to ascertain which pumps of the installation are pilot pumps. Pilot pumps are those pumps which are directly assigned to a consumer, i.e. pumps whose entry or exit is typically directly assigned to a consumer. In the majority of cases, such pumps are typically arranged upstream of the consumer, but these may however also lie downstream of the consumer, i.e. they are then pilot pumps which connect to the consumer of the suction side. Pilot pumps are thus all the pumps which directly connect to a consumer, be it on the suction side or on the pressure side. These pilot pumps are pumps which primarily supply the consumer and therefore only need to be indirectly drawn on for an energy-optimization. For this, according to embodiments of the invention, the pumps subordinate to the pilot pumps are provided, which are activated with varying rotational speeds, in order to achieve an energy-optimization. These subordinate pumps are thus varied in their rotational speeds until an energy-optimization is achieved. With this, as is described hereinafter, an energy-optimization of the pilot pumps is also achieved, which typically as regulated pumps thereby change their operating point.

Energy-optimization in the sense of the invention does not necessarily need to be a best condition, but may also lie in an improvement of the energy efficiency of the installation compared to an actual condition.

Pumps subordinate to the pilot pumps in the context of embodiments of the invention, with the pilot pumps which directly deliver into a consumer, are the pumps which are hydraulically connected in series upstream of the pilot pumps. With the pilot pumps which convey out of a consumer, which thus are connected to the consumer at the suction side, the subordinate pumps are the pumps which are hydraulically connected in series downstream.

According to an advantageous further formation of the invention one or more energy-optimization circuits are formed, which in each case consist of one or more pilot pumps and of one or more subordinate pumps, which convey into the pilot pumps or are supplied therefrom, wherein subordinate pumps in each case are assigned to only one energy-optimization circuit, whereupon the energy-optimization circuit or circuits are energy-optimized.

The basic concept thereby is thus firstly once to divide up the possibly complex hydraulic installation into energy-optimization circuits which are selected such that simplified installation parts are formed, which may be energy-optimized without great effort.

An energy-optimization circuit thereby is always formed of one or more pilot pumps and of one or more subordinate pumps, which convey into the pilot pumps or are fed therefrom. The subordinate pumps do not need to deliver into the pilot pumps or be fed therefrom in a direct manner, but also in an indirect manner, depending on how far they are hydraulically subordinated.

The energy-optimization circuits thereby are selected such that subordinate pumps in each case are assigned to only one energy-optimization circuit. One or more pilot pumps may on the other hand also be assigned to several energy-optimization circuits.

Thereby, the basic concept is to form the energy-optimization circuits, with which at least one pilot pump is at the end or the beginning, wherein the pilot pump which is directly upstream or downstream of the consumer, is to ensure the hydraulic supply of the consumer, in particular the required delivery head, whereas the pumps which are connected hydraulically in series upstream or downstream may be changed in their activation, until the total energy consumption of the energy-optimization circuit has a minimum or is at least reduced. If all such formed energy-optimization circuits are energy-optimized, then the complete hydraulic installation is also energy-optimized with regard to the operation of the centrifugal pumps incorporated therein. Thereby, the energy-optimization circuits are optimized one after the other, wherein it is of no importance in which sequence the circuits are optimized. Usefully, the optimization process is thereby effected continuously during the operation of the pumps, so that also with hydraulic changes in the installation the energy-optimization is effected afresh whilst taking into account the changed operating points of the pump.

Advantageously, an energy-optimization circuit typically comprises one or more pilot pumps, as well as one or more subordinate pumps, wherein the subordinate pumps directly deliver into at least one pilot pump or are fed directly from at least one pilot pump.

According to an advantageous further formation of the method according to an embodiment of the invention, an energy-optimization circuit includes all the pilot pumps, into which the one or the several subordinate pumps deliver or from which the subordinate pumps are fed.

In order to optimize an energy-optimization circuit according to an embodiment of the invention, a variable e is determined for each pump, which is determined by the quotients of the change of the taken-up power and the change of the delivered hydraulic power of the pump. Then, the variables e of the pilot pumps, as the case may be, i.e., if there are several, are added and are then brought into agreement with the variable e of each of the pumps connected in series upstream or downstream of these, by way of variance of the activation of these pumps, wherein pumps connected in parallel, pumps connected in series upstream or connected in series downstream are considered as one pump. Thereby, the basic concept is to put the change of the power take-up, typically of the electrical power take-up of the pump, into a relation with the change of the hydraulic power delivery and to add these quotients of the pilot pumps and then to vary the activation of the subordinate pumps until it agrees with this variable e formed by way of the addition of the individual quotients of the pilot pumps, since then, the power taken up by the energy-optimization circuit is minimal or at least minimally small. Thereby, the variable e of one of each subordinate pump is to be equated with the variable which is formed by the addition of the respective quotients of the pilot pumps. Thereby, the energy-optimization is effected in a manner such that a variable e of one or more pilot pumps is determined at the point in time t=0, and subsequently the subordinate pumps are energy-optimized as previously described, on the basis of this variable e. It is to be understood that when the subordinate pumps as far as this is concerned are energy-optimized on the basis of the variable e at the point in time t=0, this variable e of the one or more pilot pumps changes, so that at the end of the optimization procedure of the energy-optimization circuit at the point in time t=1, a variable e results at the point in time t=1, which possibly differs from the variable e at the point in time t=0. The optimization procedure may then be carried out afresh by way of the variable e of the one or more pilot pumps being determined at the point in time t=1 and the subordinate pumps being activated accordingly. The more often this procedure is carried out, the better is the result, wherein with a non-changing installation, an almost optimal value soon sets in. In order to reach the desired optimization result as soon as possible, it is particularly useful to compensate the difference of the e-values between the sum of the pilot pumps and the pump to be optimized, not in one rotational speed step, but only a part thereof, preferably between 20% and 50%. The change of the e-values of the pilot pumps is already taken into account with this. This percentage is to be adapted specific to the installation and depends on the dynamic behavior of the consumer. Thus usefully, the energy-optimization circuits are energy-optimized one after the other and continuously in the manner described above, in order to operate the installation in a manner which burdens resources as little as possible with changing operational conditions.

If pumps are connected in parallel within this energy-optimization circuit, these are considered as a common pump, thus with a common variable e, wherein for the pumps connected in parallel amongst themselves, one advantageously uses an optimization method which is yet described further below.

Usefully, the electrical power uptake P of the drive motor which with speed-controlled pumps is usually available on the part of the pump without significant effort, is used as taken-up power.

Since the hydraulic output power of a pump may only be determined with some effort, according to a further embodiment of the invention, one envisages using the delivery head h of the pump or the delivery rate q of the pump as a measure for the delivered hydraulic power. Thereby, as will be described further below, the delivery head h or the delivery rate q is used for forming the variable e depending on the hydraulic task. These variables are advantageously provided by the pump itself, since a corresponding signal with speed-controlled pumps which typically have control and regulation electronics, may be provided without great effort. Thereby, it is useful parallel to this, to provide a signal which represents a quotient of the change of the uptake of the electrical power P and the change of the delivery head h, as well as an electrical signal, which represents the quotient of the change of the taken-up power P and the change of the delivery rate q. Both signals may be applied with the method according to the invention, depending on the selection of the optimization circuit. The variables themselves typically do not need to be determined separately on the part of the pump, since e.g., with modern pumps controlled by frequency converter, the electrical and hydraulic characteristics of the pump are known for the entire characteristic curve of operating points, and are stored in an electronic memory. They may thus as a rule be determined numerically by way of linking the stored values. Instead of using the change of the hydraulic output power of the pump, a variable which is in a direct relation to this, for example with a heating installation, the change of the heat quantity Q which is a function of the delivery rate q and the temperature difference $\Delta T$ ($Q=q*\Delta T$) or another variable change which this entails, may be used.

In order to energy-optimize pumps connected in parallel, which as described further above, with the method according to embodiments of the invention, are considered as a common pump within an energy-optimization circuit, according to a further formation of the invention, one envisages activating these pumps such that the variable $e_q$ of the pumps connected in parallel is equally large, wherein the variable $e_q$ is formed by the quotients of the change of taken-up power P and the change of the delivery rate q of the respective pump. Thus with pumps connected in parallel, the delivery rate is used as a characteristic variable for the delivered hydraulic power, which makes sense, since pumps connected in parallel are provided for realizing a delivery rate which may not be provided or at least not economically by a single pump.

In heating installations, with which pumps connected in parallel are operated as so-called double pumps, one may envisage such a double pump not being provided for the parallel operation of two pumps, but merely as a replacement pump given a failure of the other pump. It is then to be understood that the shut-down pump is not to be taken into account with the energy-optimization, on account of a corresponding signal provided by this double pump.

If pumps connected in parallel have been energy-optimized as previously described, then in the method according to embodiments of the invention, they are to be considered as a single pump. Since for the energy-optimization of such pumps not connected in parallel, typically the delivery head h, thus the delivery pressure is used as a variable for the hydraulic power, with the method according to embodiments of the invention, with pumps connected in parallel, the variable $e_h$ is formed by way of determining the quotient of the change of taken-up power P and the change of the delivery head h of each of the pumps connected in parallel, and then adding these quotients.

With pumps connected in series, be it a case of individual pumps or groups of pumps connected in parallel, said individual pumps or groups of pumps being arranged in series or of both, advantageously for energy-optimization, one uses a variable $e_h$, which is formed by the quotient of the change of taken-up power P and the change of delivery head h of the respective pump or pump group (as previously described). This variable $e_h$ is then equated to the corresponding variable $e_h$, which, as the case may be, is formed by addition, of the associated pilot pumps, wherein by way of variance of the control of the subordinate pumps, one obtains the same variables on both sides and thus an energy-optimization is achieved.

The energy-optimization method according to embodiments of the invention runs up against its limits when a pump goes into saturation, i.e., delivers on the curve of its maximal power. Then this pump may no longer be activated in a power-increasing manner, which is to be taken into account with the energy-optimization method, be it a pilot pump which reaches the saturation limit and being corresponding hydraulically supported by subordinate pumps, or a subordinate pump which reaches the saturation limit and inasmuch as this is concerned not being able to be actuated for the uptake of a higher power in the course of the energy-optimization method.

The energy-optimization method according to embodiments of the invention fundamentally assumes the knowledge of the functional relationship of the hydraulic installation. According to a further embodiment of the invention, the functional relationship of the hydraulic installation may however be determined by the pumps themselves by way of a suitable activation of the pumps in the system. Thereby, according to embodiments of the invention, of the pumps in the installation, one envisages at least one pump firstly being activated with a first rotational speed and then with a rotational speed which is changed compared to the first rotational speed, wherein the hydraulic variables or changes which result with this are detected on the consumer side and/or on the pump side and information on the hydraulic arrangement are made by way of these values. Thus for example of two pumps, by way of speed activation of one of the pumps and pressure measurement or quantity measurement, one may ascertain without further ado, as to whether the pumps are connected in parallel or in series. According to this principle, finally the functional hydraulic relationship of the complete installation may be determined as is illustrated further below by way of an embodiment example.

According to embodiments of the invention, the functional relationship of several pumps in an installation, which are controllable in their speed, is determined by way of changing the rotational speed at at least one pump, and determining at least one functional relationship of the installation from the resulting hydraulic reaction. Depending on the scope of the functional relationship to be determined, one may activate one or also several pumps with a changed rotational speed, in order to determine this relationship. Thus for example, for ascertaining whether two pumps are connected in parallel or in series, it may be sufficient to activate one of the pumps with an increased rotational speed, in order then by way of pressure measurement or throughput measurement compared to the initial condition, to determine in which way these pumps are connected.

According to an advantageous further embodiment of the invention, the method is applied in three basic steps, specifically as follows:

a) first, all pumps installed in the installation are activated with a preferably constant rotational speed, and a hydraulic variable is detected for each pump or for each consumer assigned to the pumps or for each consumer group, if several consumers are assigned to a pump. Typically, the pumps thereby are activated with a constant medium rotational speed and specifically until quasi stationary values set in. These values are detected on the part of the pump or consumer, and hereby it is the case selectively of the pressure or the volume flow (delivery rate), wherein these do not necessarily need to be detected in a direct manner, but may be determined indirectly in a manner known per se also by way of other variables, e.g., electrical variables of the drive of the pumps.

b) then successively, in each case, one of the pumps or several pumps are activated with a changed rotational speed and the change of the hydraulic variables which results in each case is detected. Thus each individual pump is typically activated with a rotational speed which is increased compared to step a, and then the changes of the hydraulic variables which result either on the part of the consumer or on the part of the pump are detected, wherein on the pump side the hydraulic variables of the pump activated with a changed rotational speed as well as that of the other pumps are detected. Basically thereby, it is of no significance as to whether the changed rotational speed is one which is increased or reduced compared to the rotational speed according to step a, but as a rule a rotational speed which is increased with respect to this is advantageous. It is to be understood that one after the other, all pumps must be operated either with a rotational speed which is increased or however reduced compared to the rotational speed in step a, in order to detect the hydraulic changes of the hydraulic variables which result with this.

c) third, after the changes of the hydraulic variables have been detected, one determines the assignment of the pumps or pump group to the consumers or consumer groups by way of these detected hydraulic variable changes.

The method according to embodiments of the invention may be implemented into the digital frequency converter electronics with the advantageous use of pumps controlled by frequency converter, wherein then a data connection of the pumps amongst one another, be it in a wireless manner per radio or for example via mains cable, should be formed, in order to accordingly coordinate the pumps with regard to the method, and further to detect the hydraulic variables at the pumps or at the consumers. However, this method may also be implemented in a separate control, which is data-connected in a wireless manner or by wire to the pumps and, as the case may be, to the consumers or their sensors.

The method according to embodiments of the invention provides the great advantage that it may be carried out with equipment which is present in any case in the heating installation, i.e., no additional measures in the installation need to be provided with the exception of the control and the data connection. The control and data connection, given a suitable design of the pumps, may however be integrated into these pumps with very small additional costs. The data connection is furthermore not required for the energy-optimization method to be subsequently applied.

The evaluation of the thus determined hydraulic variables and variable changes may be effected in a simple manner. Thereby, the methods differ fundamentally with regard to whether the hydraulic variables or their changes are detected on the part of the pump or on the part of the consumer.

If the variables are detected on the consumer side, i.e., at a consumer or consumer group, if several consumers are assigned to a pump, then according to a further formation of the method, at the pumps which on activation with a changed rotational speed produce the same consumer-side hydraulic variable changes, one ascertains that these are assigned to a pump group. A pump group includes one or more pumps which are connected in a direct manner in parallel and/or in series. The first assignment step thus with a variable detection at the consumer side, lies in determining whether the pumps are hydraulically connected as individual pumps or in groups, in the installation.

According to a further advantageous design of the method, if given a speed change of one or consecutively also several pumps, only one consumer or a consumer group is influenced in an increasing or reducing manner according to the speed change, then the pump or pumps are directly assigned to the respectively influenced consumer or to the respective influenced consumer group, i.e., no further pumps are located any longer in the conduit path between the previously mentioned pump/the previously mentioned pumps and the consumer or the consumer group.

In order to determine the functional relationship within a pump group, according to a further embodiment of the method according to the invention, one envisages activating all pumps of the pump group with a constant speed, thus for example according to the method step a, wherein then the pressure difference produced by the respective pumps is detected, for example, by way of a differential pressure sensor at the respective pump. Thereafter, in each case one after the other, one of the pumps is activated with a changed, preferably increased pressure, and the differential pressure change or speed changes of the other pumps, which result thereby, are detected, whereupon then the assignment of the pumps within the pump group is determined by way of the detected variable changes, as results by way of the hydraulic laws with a parallel connection or series connection of pumps. In order to be able to determine the functional relationship within the pump group, either the pumps of a pump group may be subsequently activated with a changed, preferably increased rotational speed, and the throughput rate through the respective pump detected, or the pumps one after the other are activated in each case for producing an increased differential pressure, wherein then the resulting pressure level of this and other pumps is detected, and the assignment of the pumps within the pump group is determined by way of the changes which result, as the case may be.

According to a further embodiment of the method according to the invention, the pump or the pumps, which with their rotational speed change influence two or more consumers or consumer groups in an increasing or decreasing manner according to the rotational speed change, are assigned according to the number of influenced consumers or consumer groups. Thus one may determine which pumps are to affect which consumers, and thus the assignment of the pumps amongst one another, is determined.

It is particularly advantageous if, with the method according to embodiments of the invention, it is not the absolute values of the hydraulic variables or variable changes which are detected, but only their direction, since then, on the one hand, one may apply very simple and non-calibrated sensors systems, and on the other hand the evaluation only requires a small computation effort as well as a reduced memory requirement. Thus for carrying out the method according to embodiments of the invention, it is sufficient to detect whether the respectively detected hydraulic variable increases, reduces or stays the same with a speed change or pressure change of a certain pump. Thus, it is only a question of a simplified direction detection, which is adequately accurate if it may be categorized in three groups, specifically larger (+1), smaller (−1) and the same (0).

If the method according to embodiments of the invention is to be carried out by way of detecting the hydraulic variables of the pumps, thus for example the pressure or the volume flow, which as a rule is more favorable with regard to the installation, since heating circulation pumps controlled by frequency converter nowadays are regularly provided with differential pressure sensors, then it is useful firstly once to determine with the method as to whether the hydraulic installation is a hydraulic network or whether it consists of two or more installation parts which are independent of one another. With installation parts which are independent of one another, a speed-changed or pressure-increased activation of the pump has no influence whatsoever on the other part, so that in this manner, one may determine firstly once the installation parts which are hydraulically connected to one another.

The methods with which hydraulic variables of the pumps, typically pressure or differential pressure or volume flow are detected for determining the functional relationship, again fundamentally differ from one another.

If as is envisaged according to a further embodiment of the invention, with all pumps the volume flows and thus volume flow changes are detected as hydraulic changes, the functional relationship may be determined as follows, wherein hereinafter the changes on activating a pump with an increasing speed are noted. However, one must emphasize that the changes may also be used in an analogous manner if the activation is effected with a reduced rotational speed:

A matrix is formed, in which the hydraulic changes of at least one hydraulically independent installation part are detected, wherein advantageously here too, the direction changes are detected, thus the matrix is formed with the values 0 for remaining the same, +1 for increasing and −1 for reducing. Thereby, for each pump, the changes of the hydraulic variables at this pump as well as at the other pumps, which result with its activation with a changed rotational speed, are specified in rows. Moreover, a column is assigned to each pump, whereby the rows within the matrix are sorted, and specifically increasing from the top to the bottom according to their number of increasing changes (+1), and the columns increasing from the left to the right according to their number of increasing changes (+1). Thus the changes of the pump which produce the fewest increasing changes in the entirety of the pumps are detected in the uppermost row of the matrix, and the associated column of this pump connects at the same location at the top left of the matrix. The pump with the most increasing changes is in the last, thus lowermost row, wherein then also the last column, thus the column at the far right, is assigned to this pump. It is to be understood that the matrix may also be arranged exactly in the reverse manner, since it is compellingly mirror-symmetrical with regard to its diagonals.

The matrix is divided by a diagonal, which runs from the one to the other matrix axis, which quasi intersects or erases the fields of the matrix, in which an increasing variable change, this typically a 1 is located. These are the fields with which the pump assignment of the column and row agrees. By way of observing the number of increasing changes of the hydraulic variables in each column below the previously mentioned diagonal or in each row above the previously mentioned diagonal, one may determine which pumps are connected hydraulically in parallel and which ones hydraulically in series.

With the pumps with which an equal number of increasing changes (+1) of the hydraulic variables in the columns below the diagonal or in the rows above the diagonal of the matrix is given, it is the case of pumps connected in parallel, thus of those pumps which deliver from the same conduit and from the same pressure level.

According to a further embodiment of the method according to the invention, pumps which are assigned directly to a consumer or to a consumer group are determined, i.e., which deliver into such a consumer or a consumer group without intermediate connection of further pumps. Hereby, it is the case of pumps with which no increasing change of the hydraulic variables in a row below the diagonal or in a column above the diagonal of the matrix is present. The first pump of the matrix may belong to this as the case may be, which is assigned to the first row and the first column and lies on the diagonal. This results from the row sorting or the column sorting.

According to a further embodiment of the method according to the invention, by way of evaluating the matrix, one determines how many pumps are hydraulically connected in series upstream of the respectively considered pump. For this, the number of increasing changes of the hydraulic variables in the columns below the diagonals or in the rows above the diagonals of the matrix, are detected. This number corresponds to the number of the pumps which are connected in series upstream of the respective pump, wherein no information is given with regard to the hydraulic connection of the pumps connected in series upstream.

According to one method variant, with which the matrix is formed in the same manner as previously described, one may determine which pumps are connected hydraulically in parallel and which ones hydraulically in series, by way of the number of increasing changes of the hydraulic variables in each row below or in each column above a diagonal dividing the matrix and running from one to the other matrix axis. Thereby, according to a further formation of the method according to embodiments of the invention, the number of increasing changes of the hydraulic variables in the rows below the diagonals or in the columns above the diagonals of the matrix may be used for determining the number of pumps which are hydraulically connected in series downstream of the respective pump, and thus the number may be assigned.

The method according to embodiments of the invention, if the hydraulic variables of the pump are evaluated, may either be carried out by way of detecting the volume flow of the pumps or alternatively the pressure or differential pressure of the pumps. If the determining is to be effected via the pressure changes, then according to an embodiment of the invention, a matrix is formed in the same manner as previously described, in which the hydraulic changes of at least one hydraulically independent installation part are detected, wherein here too in rows for each pump, the changes of the hydraulic variable which results with its activation for delivering with a changed pressure, is specified at this pump and the other pumps, and wherein a column is assigned to each pump. Thereby, the rows are sorted increasing from the top to bottom according to their number of reducing changes (−1), and the columns are sorted from the left to the right according to their number of reducing changes, wherein then one determines which pumps are hydraulically connected in parallel and which are connected hydraulically in series by way of the number of reducing changes of the hydraulic variable in each column below, or in each row above a diagonal which divides the matrix and which runs from the one to the other matrix axis. Here too, the diagonal forms a symmetrical partition of the matrix and runs through the fields which have been indicated as always increasing and which in the row and column concern the same pump in each case. These fields are not co-counted with the subsequent evaluation, just as with the previously described one.

Thereby, an equal number of reducing changes of the hydraulic variables in the columns below the diagonal or in the row above the diagonal of the matrix indicates a connection of the respective pumps in parallel.

A different number of decreasing changes of the hydraulic variables in columns below the diagonal or in rows above the diagonal indicates the connection of the respective pumps in series.

If a row below the diagonal has no reducing change of the hydraulic variables or a column above the diagonal of the matrix, then this determines the direct assignment of the respective pump to a consumer or to a consumer group.

The number of reducing changes of the hydraulic variables in the columns below the diagonal or in the rows above the diagonal of the matrix according to a further formation of the method according to the invention indicates the number of pumps which are hydraulically connected upstream in series of the respective pump.

According to a further embodiment of the method according to the invention, one alternatively determines which pumps are connected hydraulically in parallel and which ones are connected hydraulically in series, by way of the number of reducing changes of the hydraulic variables in each column below, or in each row above a diagonal dividing the matrix and running from one to the other matrix axis. Thereby, the pumps which have the same number of reducing changes of the hydraulic variable in the column below, or in the row above the diagonal of the matrix, are connected hydraulically in parallel, and those with a different number are connected hydraulically in series.

According to a further embodiment of the method according to the invention, the number of the reducing changes of the hydraulic variables in the rows below the diagonal or in the columns above the diagonal of the matrix indicates the number of the pumps which are hydraulically connected in series downstream of the respective pump.

Thus it becomes clear that the previously described matrix unambiguously determines the functional relationship of the pumps when the hydraulic variable change is detected at each pump. On detecting hydraulic changes at the consumer or consumer group, as the case may be, it may be necessary as initially described, to differentiate additional pump groups as to whether they are connected in parallel or series by way of changing a hydraulic variable of the pump.

The energy-optimization method and also the previously described method for determining the functional relationship of the pumps may also be realized by way of an electronic control and regulation device, which is typically designed as a digital control and regulation unit and has a data connection to the pumps. Such a data connection may, for example, be effected in a wireless manner via radio or also connected by wire in the manner of a network connection between the pumps and the control and regulation unit. The control and regulation unit may also form part of the pump. Particularly usefully, it may be usual to provide a control and regulation unit, which is data-connected to the pumps, so that one may practically use any pumps for application of the method according to embodiments of the invention, if these are suitably modified, i.e., have at least one data connection for connection to the control and regulation unit. However, it is particularly useful if the pumps themselves are designed such that they provide the variables necessary for the regulation method, in particular the variable $e_n$ which indicates the quotient of the change of the taken-up power P and the change of the delivery head h, as well as $e_q$ which represents the quotient of the change of the taken-up power P and the change of the delivery rate q of the pump. These values are typically available in the control electronics in any case with speed-controllable pumps, which is why it would only make sense in exceptional cases to determine these separately in an external control and regulation unit. Furthermore, the control electronics of the pumps produce a signal S when and for as long as the respective pump has reached its power saturation. It is to be understood that with a digital signal processing, a signal is always present and a value is set from 0 to 1 or in reverse which represents the saturation.

According to a further embodiment of the invention, it may be useful to provide a part of the control and regulation device on the pump side, for example for the energy-optimization of pumps connected in parallel and in contrast to only provide the part of the control and regulation unit as an external apparatus, which serves for the optimization of the energy-optimization circuits or of the complete installation.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention inasmuch as it relates to the optimization method, is hereinafter explained in more detail by way of embodiment examples. There are shown in the drawings.

DETAILED DESCRIPTION OF THE INVENTION

Figure 1:
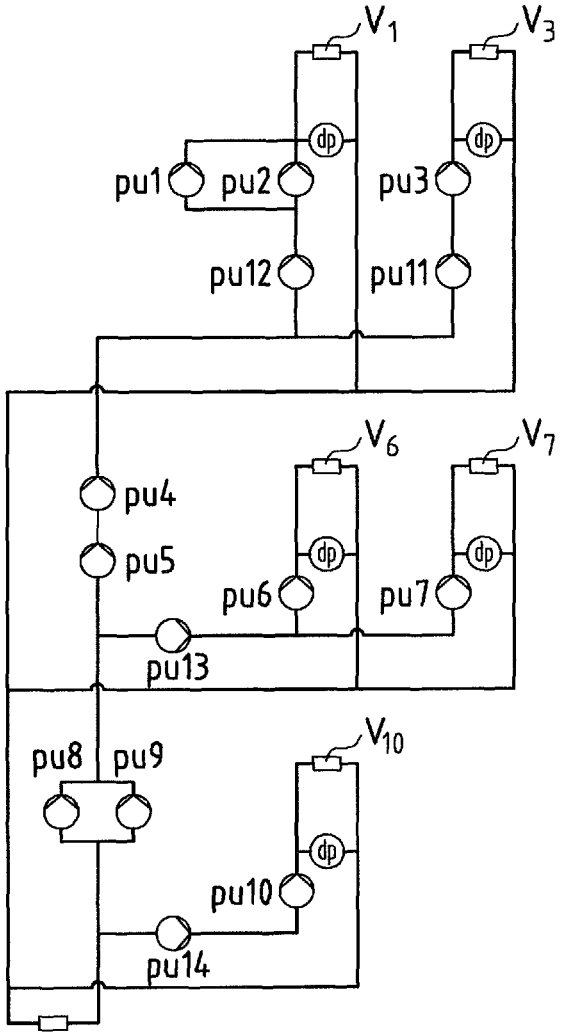
FIG. 1 is a circuit diagram of a hydraulic installation.
Figure 2:
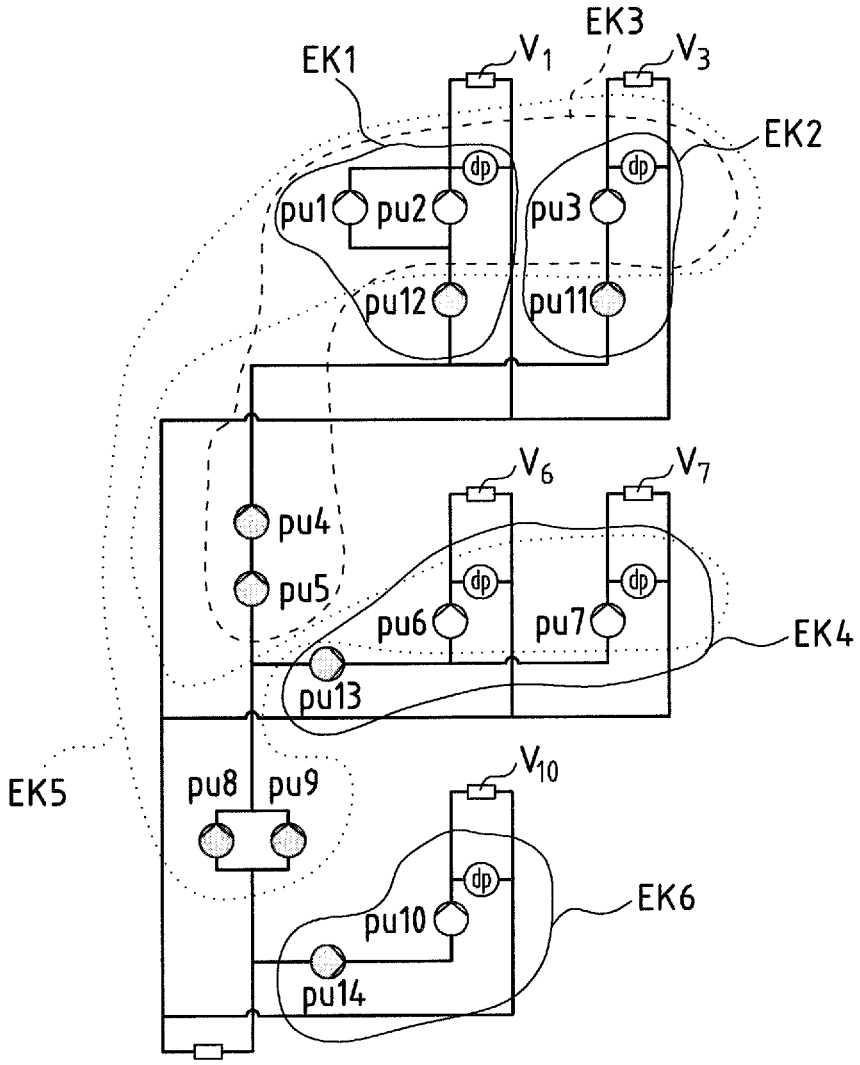
FIG. 2 is the arrangement of the energy-optimization circuits in the installation according to FIG. 1.

The hydraulic installation represented by way of FIG. 1 for example represents a heating installation which in total includes 5 consumers or consumer groups V1, V3, V6, V7 and V10, as well as 14 speed-controllable centrifugal pumps pu1-pu14. One should firstly form energy-optimization circuits, in order to optimize the use of the installation with regard to the operation of the pumps. For this, one should firstly ascertain which pumps form pilot pumps, i.e., one should determine the pumps which are directly assigned to a consumer. In the circuit diagram according to FIG. 1, these are the pumps pu1, pu2, pu3, pu6, pu7 and pu10. Thereby, the pumps pu1 and pu2 are connected in parallel and are connected in series upstream of the consumer V1, i.e., assigned in a direct manner. The pumps pu3, pu6, pu7 and pu10 are connected upstream of the respective consumers V3, V6, V7 and V10.

In order to form energy-optimization circuits, one or more pilot pumps and the subordinate pumps which deliver into these are now assigned to an energy-optimization circuit. A first energy-optimization circuit EK1 is formed by the two pilot pumps pu1 and pu2 which are arranged in parallel to one another, as well as the pump pu12 which delivers into these and is connected upstream. A second energy-optimization circuit EK2 is formed by the pilot pump pu3 and the pump pu11 which delivers into this and is connected upstream. A third energy-optimization circuit EK3 is formed from the three pilot pumps pu1, pu2, pu3 as well as the pumps pu4 and pu5 which are arranged upstream and lie in series to one another. A fourth energy-optimization circuit EK4 is formed by the two pilot pumps pu6 and pu7 as well as the pump pu13 which is connected upstream of these. Moreover, a fifth energy-optimization circuit EK5 is formed, which is formed from the pilot pumps pu1, pu2, pu3, pu6 and pu7 as well as the pumps pu8 and pu9 which are connected upstream. The further pumps which are also connected upstream of these pilot pumps are not assigned to this energy-optimization circuit EK5, since they are already assigned to other energy-optimization circuits. Finally, an energy-optimization circuit EK6 is formed, which consists of the pilot pump pu10 and the pump pu14 which delivers into this and is arranged upstream.

The energy-optimization circuits EK1-EK6 from now are energy-optimized one after the other, by which the complete installation is energy-optimized with respect to the pump operation. Thereby, firstly with regard to the pilot pumps, a variable $e_h$ is determined in each energy-optimization circuit, by way of the quotient of the change in the taken-up pump power P and the change of the delivery head h being determined during installation operation of these pumps. If two or more pilot pumps are present in an energy-optimization circuit, as for example in the circuits EK1, EK3, EK4 and EK5, then the variables $e_h$ of the pilot pumps are added and are equated individually to the variable $e_h$ of each of the pumps connected upstream. Thereby, the pumps connected upstream are activated with a correspondingly changed rotational speed, until these e-values are the same and thus the energy-optimization circuit is optimized. Thus for example, in the energy-optimization circuit EK4, the e-values of the pumps pu6 and pu7 are added, and the pump pu13 is variably activated until the variable $e_h$ of the pump pu13 corresponds to the sum of the variables $e_h$ of the pumps pu6 and pu7.

In an analogous manner with the energy-optimization circuit EK3, the variable $e_h$ of the pumps pu1, pu2 and pu3 are added and are equated one after the other to the variable $e_h$ of the pump pu4 as well as the pump pu5, and the pumps pu5 and pu4 are activated in a variable manner until these values agree.

If, as with the energy-optimization circuit EK5, two pumps are connected in parallel as is the case with the pumps pu8 and pu9, then firstly these pumps connected in parallel are energy-optimized, by way of determining a variable $e_q$ on operation of each of these pumps, which specifies the change of the taken-up power P to the change of the delivery rate q. The pumps pu8 and pu9 are then activated in their rotational speed by way of variance until the variables $e_q$ of both pumps agree. The pumps pu8 and pu9 are then considered as one pump for the energy-optimization within the energy-optimization circuit EK5. For this, a variable $e_h$ is determined from these pumps, by way of the quotient of the change in taken-up power P of a pump and the change of the delivery head h for each of these pumps being detected and added. The energy-optimization within the energy-optimization circuit EK5 is then continued by way of this variable $e_h$ of the two pumps pu8 and pu9 being equated with the sum of the respective variables $e_h$ of the pilot pumps.

Figure 3:
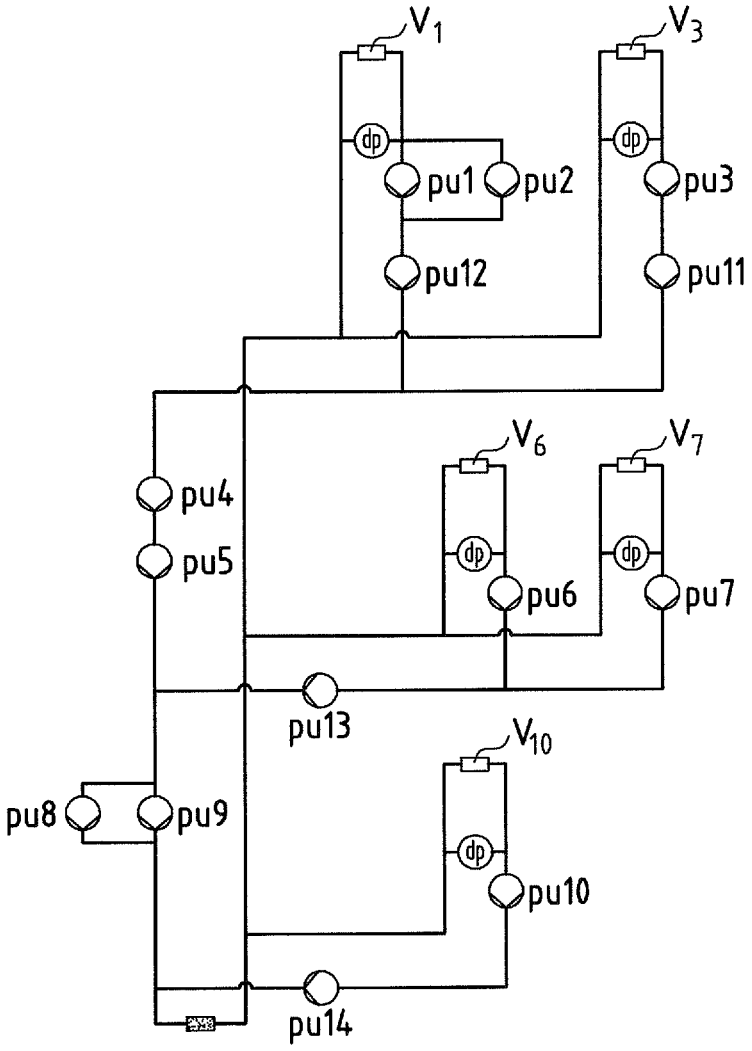
FIG. 3 is the hydraulic circuit diagram of another hydraulic installation.
Figure 4:
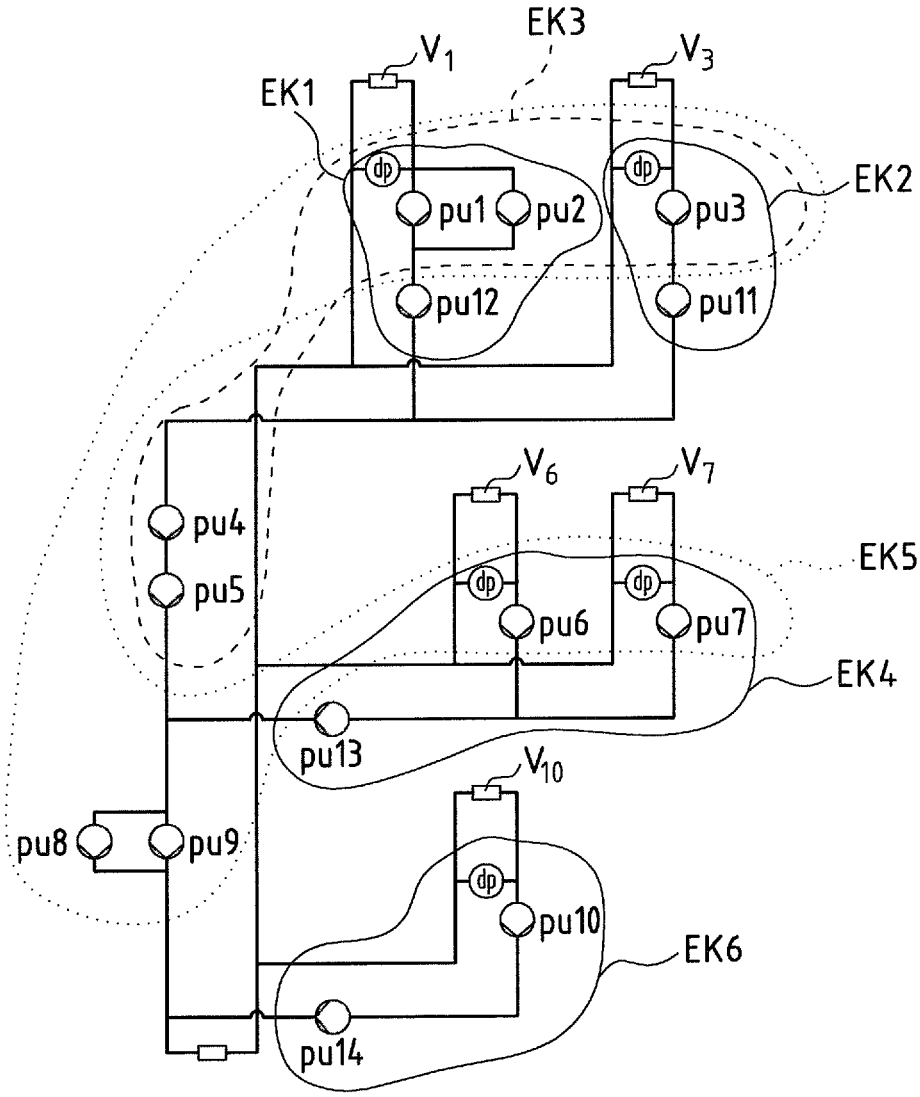
FIG. 4 is the position of the energy-optimization circuits in the installation according to FIG. 3.

The hydraulic installation represented by way of FIG. 3 corresponds in its function essentially to the previously described one which is represented by way of FIG. 1, but with the difference that the pumps pu1 to pu14 there, in contrast to FIG. 1, are not connected in the inflow to the consumers V, but in the return thereto. The pilot pumps are thus connected to the consumers V on the suction side, and the pumps which are subordinate to the pilot pumps here are connected hydraulically downstream. Thus, in an analogous manner result the pilot pumps pu1 and pu2, which are assigned to the consumer V1, and the pilot pumps pu3, pu6 pu7 and pu10, which are assigned to the consumers V3, V6, V7 and V10. The pumps connected upstream result accordingly, as the energy-optimization circuits EK1-EK 5 indicate in FIG. 4.

Figure 5:
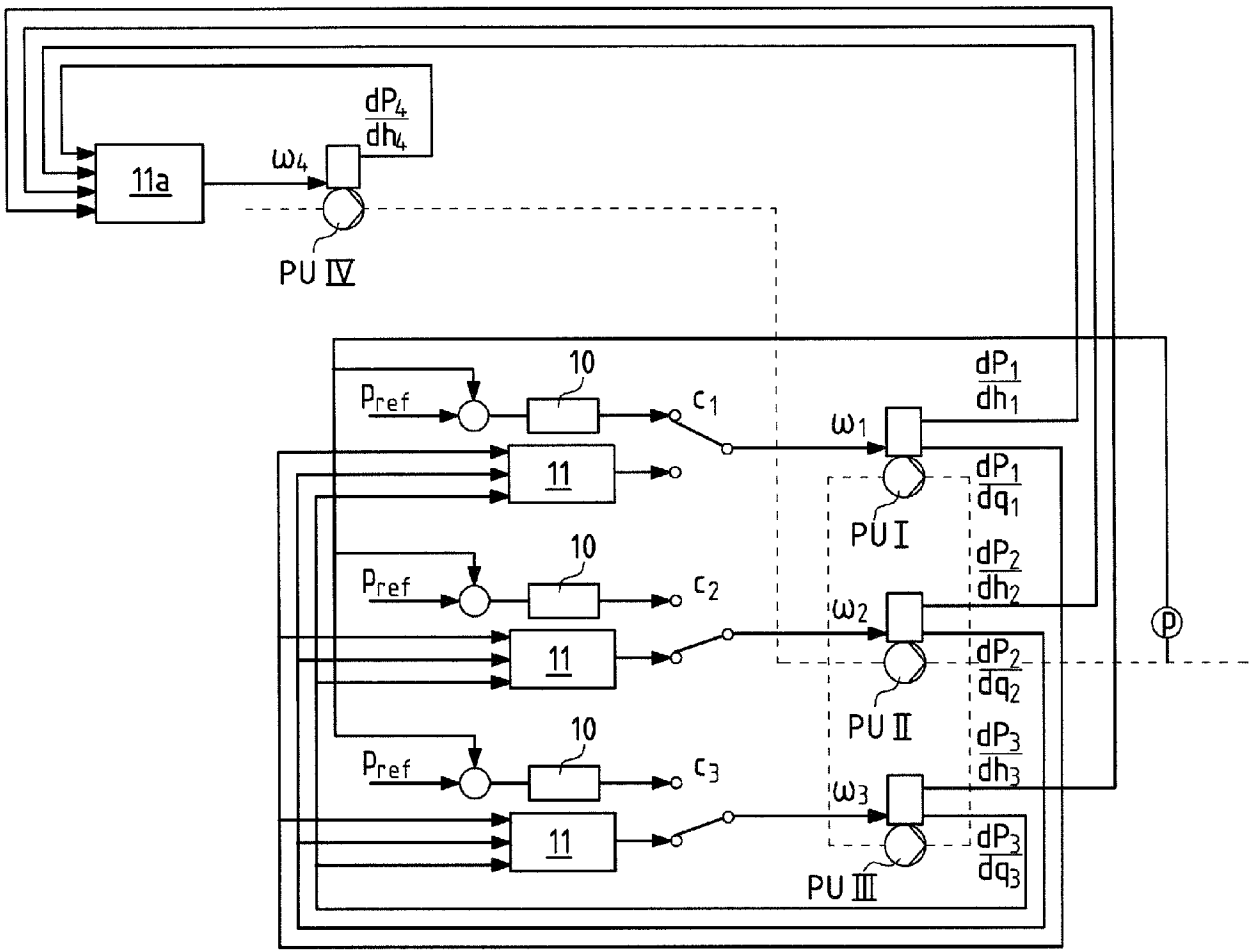
FIG. 5 is an energy-optimization circuit diagram with which 4 pumps are connected to one another.

It is illustrated by way of FIG. 5 how four pumps puI-puIV, which are hydraulically connected to one another, are data connected to one another and how the energy-optimization is effected. Thereby, the hydraulic connections are represented by interrupted lines and the data connections in continuous lines. In the represented embodiment, the pump puIV is connected upstream of the pumps puI, puII and puIII, wherein the pumps puI, puII and puIII are connected in parallel and represent pilot pumps with respect to a consumer connected at the output side. Thereby, in FIG. 5, a speed controller 10 as well as an energy-optimization circuit 11 is assigned to each pump. An energy-optimization unit 11*a*, which is designed as an external unit, is assigned to the pump puIV connected upstream, whereas the units 111 form a part of the respective pump. Since the pumps puI, puII and puIII are connected in parallel, these are firstly optimized to one another by way of the pumps being activated in a manner such that their variables $e_q$ which are formed by the difference quotients or differential quotients of the power uptake P and delivery rate q of each individual pump, are equated, i.e., the pumps are activated with variable speeds by way of the speed controller 10, until these values agree. Thereby, as the representation according to FIG. 5 illustrates, one of the pumps connected in parallel, which ensures the production of the delivery pressure to be mustered by the pumps, is always excluded from the energy-optimization, and the other two pumps may then be energy-optimized with regard to the delivery rate. In the representation according to FIG. 5, the pump puI as a pilot pump is connected for pressure control, whilst the pumps puII and puIII together with the pump puI share the necessary delivery rate. The pump puIV connected upstream fulfills a pressure task, which is why the energy-optimization here is effected via the variable $e_h$ which is formed by the difference quotient or the differential quotient of the power uptake P and delivery head h.

As the representations illustrate, it is useful if all pumps participating in the method produce a signal $e_q$ as well as a signal $e_h$, wherein the signal $e_q$ is used with pumps connected in parallel and the signal $e_h$ is used with pumps connected in series. With pumps connected in parallel, additionally after optimization of the group of pumps connected in parallel, the signal $e_h$ is used in order to energy-optimize the group in combination with the other pumps quasi as a single pump.

Figure 6:
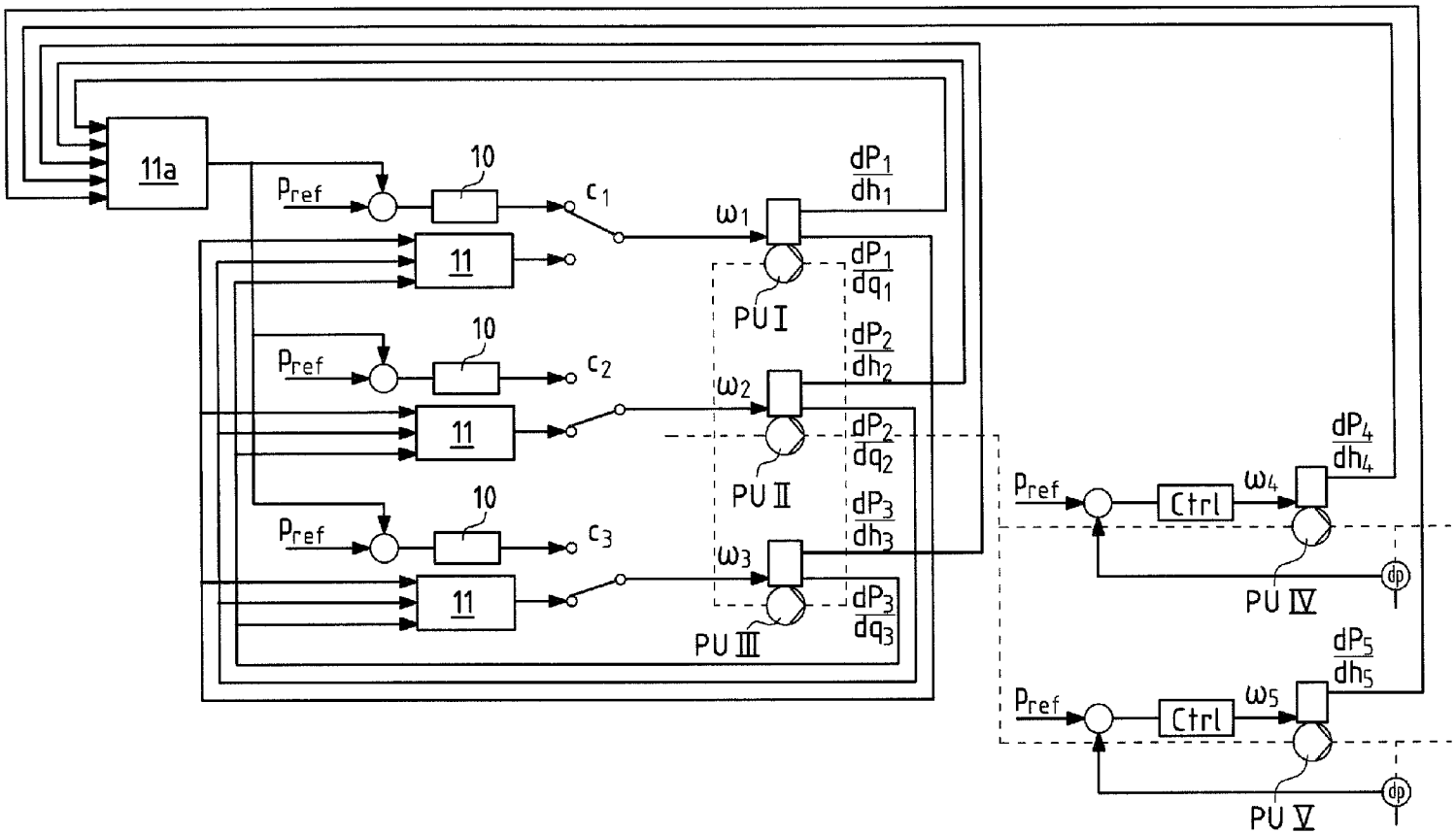
FIG. 6 is an energy-optimization circuit diagram with which 5 pumps are connected to one another.

An energy-optimization procedure of five pumps puI, puII, puIII, puIV, and puV is represented by way of FIG. 6, wherein as in the embodiment example according to FIG. 5, the pumps PUI, PUII and PUIII are connected in parallel, and the pilot pumps puIV and puV are connected in series upstream. Here too, firstly an internal optimization is effected by way of the energy-optimization devices 11 via the signals $e_q$, and subsequently an energy-optimization of the pump group consisting of the pumps puI, puII puIII via the energy-optimization device 11 to the pilot pumps puIV and puV. Thereby, the variables $e_h$ of the pumps puIV and puV are added and equated to the sum of the $e_h$ variables of the pumps puI, puII, puIII connected in series upstream of the pilot pumps and connected in parallel and the latter pumps are activated with a varied speed until the previously mentioned $e_h$ variables agree and thus an optimization of this energy-optimization circuit is effected.

For an improved understanding, the variables $e_h$ in the drawings are represented as dP/dh and the variables $e_q$ as dP/dq/dq, in each case provided with the number which corresponds to the numbering of the respective pump.

Embodiments of the invention, inasmuch as they relate to the method for determining the functional relationship of pumps in an installation, is hereinafter explained in more detail by way of FIGS. 7-14.

Figure 7:
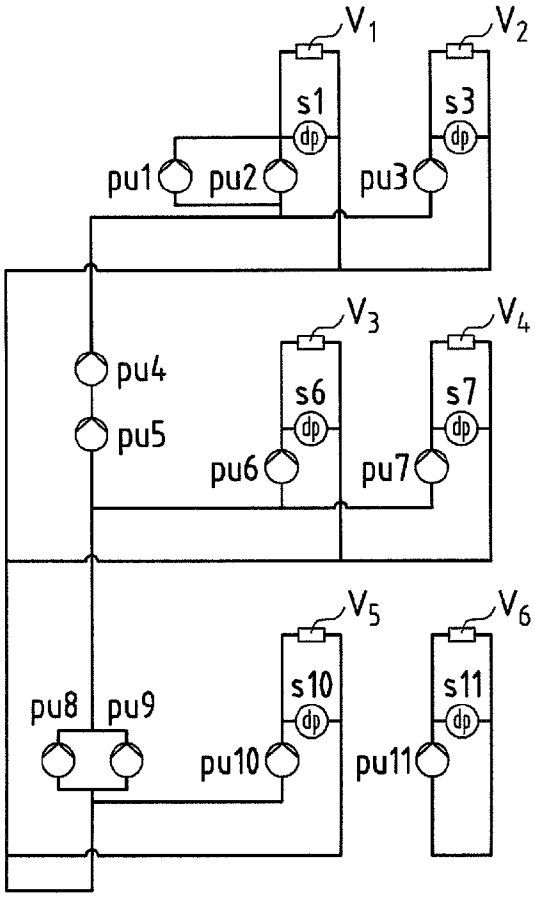
FIG. 7*a* is a hydraulic circuit diagram of an installation with several pumps and consumers.
FIG. 7*b* is a matrix with regard to the installation according to FIG. 7*a;*
Figure 8:
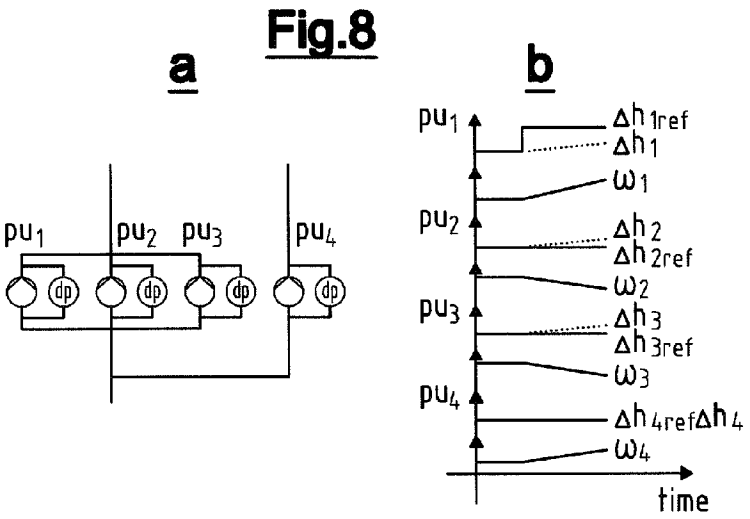
FIG. 8*a* a circuit diagram of four pumps arranged in parallel.
FIG. 8*b* is a chart showing the temporal behavior of the pumps in FIG. 8*a* with a pressure increase.
Figure 9:
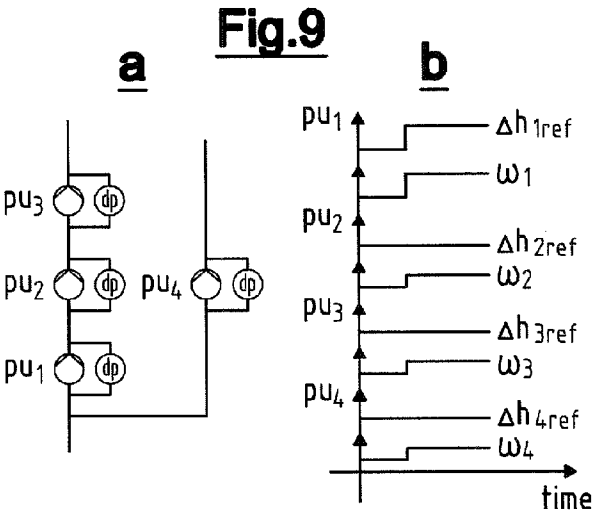
FIG. 9*a* is a circuit diagram of a pump group of pumps arranged in parallel and in series.
FIG. 9*b* is a chart showing the temporal behavior of the pumps of FIG. 9*a* with an activation with a changed rotational speed.
Figure 10:
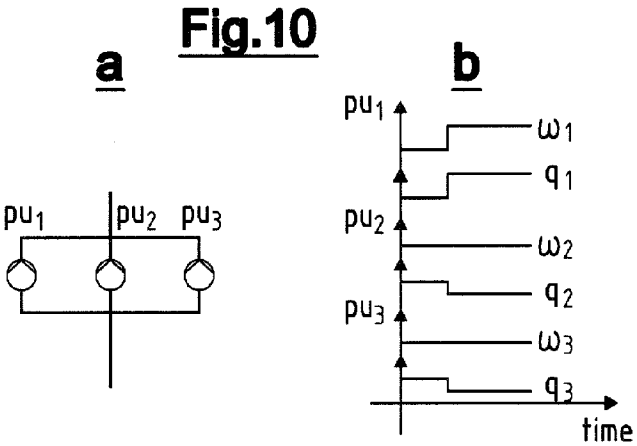
FIG. 10*a* is a circuit diagram of three pumps arranged in parallel.
FIG. 10*b* is a chart showing the temporal behavior of the pumps of FIG. 10*a* with a change in rotational speed.
Figure 11:
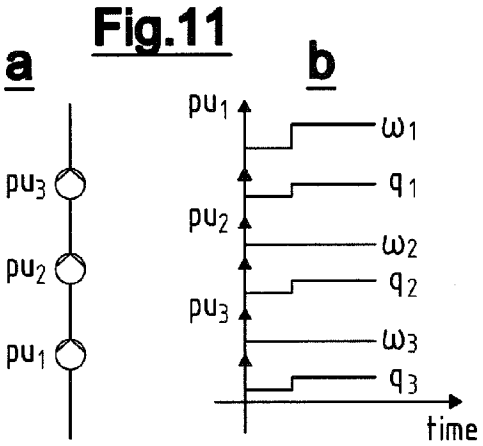
FIG. 11*a* is a circuit diagram of three pumps arranged in series.
FIG. 11*b* is a chart showing the temporal behavior of the pumps of FIG. 11*a* with activation with a change in rotational speed.
Figures 12, 13, 14:
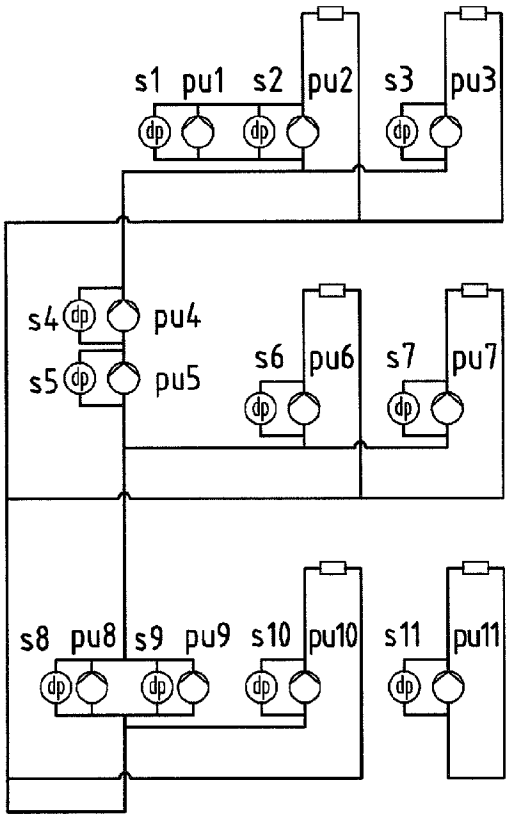
FIG. 12 is a hydraulic circuit diagram of a hydraulic installation according to FIG. 7, but with a pump-side sensor arrangement.
FIG. 13 is a first matrix with regard to the installation according to FIG. 12.
FIG. 14 is a second matrix with regard to the installation according to FIG. 12.

The hydraulic installation represented by way of FIG. 7 and FIG. 12 is a heating installation which here is not to be explained in detail. It is equipped as a whole with 11 pumps pu1-pu11. These in total 11 pumps supply 6 consumers V1-V6. These consumers may be individual consumers, but are typically consumer groups such as for example a network of heat exchangers connected in parallel, as is normal in the construction of apartments for room heating, which as the case may be, may also be connected in groups in parallel and/or in series. A sensor S1, S3, S6, S7, S10 and S11 is assigned to each consumer and detects the pressure dropping at the consumer.

The installation includes two installation parts which are hydraulically independent of one another, specifically of the installation part represented at the bottom right in FIG. 7*a* consisting of the pump pu11 and the consumer V6, as well as the remaining installation part. In the remaining installation part, in the lowermost plane, a pump pu10 supplies a consumer V5, two pumps pu8 and pu9 connected in parallel feed the consumer V3 via a pump pu6 connected in series downstream, as well as parallel to this, the consumer V4 via a pump pu7 connected in series downstream. The pumps pu1, pu2 and pu3 are supplied via the pumps pu5 and pu4 connected in series and for their part however connected in parallel supply the consumer V1 and the consumer V2 respectively. This arrangement is selected at random and exclusively serves for illustrating the method according to an embodiment of the invention.

For carrying out the method, now firstly, all pumps pu1 to pu11 are activated with a constant rotational speed, typically of a medium rotational speed which is selected such that the installation is operated according to directed use, but reserves are present so that the pumps, as the case may be, may be activated with a rotational speed which is increased with respect to this. With regard to the pumps, it is typically the case of heating circulation pumps which are controlled by frequency converter, as are normal in the market.

All pumps are operated at a constant rotational speed and this rotational speed should be constant with respect to the respective pump, but of course the rotational speeds may differ amongst one another. If one of the pumps during the method must be activated with a changed rotation speed on account of a requirement on the part of the installation, then this may be effected when the correspondingly changed rotational speed is taken numerically into account. Pressures are detected at the sensors S1, S3, S6, S7, S10 and S11 during this activation. Now a first pump, e.g., the pump pu1 is activated with a changed rotational speed, for example with an increased rotational speed and the changes which set in as the case may be or also the non-changes, are detected by way of the sensors S1, S3, S6, S7, S10 and S11.

A matrix is usefully set up for this, as is represented in FIG. 7*b*. In the matrix, the pumps pu1-pu11 are listed on the one axis which here is vertical, and the sensors S1-S11 on the other, here horizontal axis, in order then, in the fields which results with this, to detect whether and, as the case may be, which hydraulic changes result on activating a pump with an increased rotational speed. Thereby, a categorization in 0, −1 and 1 is effected, wherein 0 indicates no change, 1 an increasing hydraulic variable and −1 a reducing hydraulic variable.

On activating the pump pu1 with an increased rotational speed, thus according to FIG. 7*b*, an increasing pressure difference results at the sensor S1, a reducing pressure difference at the sensor S3, a reducing pressure difference at the sensor S6, a reducing pressure difference at the sensor S7 and likewise a reducing pressure difference at the sensor S10, compared to a prior activation of this pump pu1 at a reduced rotational speed. The sensor S11 detects no change since it relates to an installation part which is not hydraulically connected to the pump pu1. If these changes are detected, the pump pu1 is moved down again to the previously activated constant first rotational speed, whereupon now the pump pu2 is activated with an increased rotational speed and the changes resulting at the sensors S1-S11 are plotted in the matrix. This is effected hereinafter with all pumps until the matrix is set up completely as in FIG. 7*b*.

The matrix representation here is set up only for a simplified numbered representation, but is basically not necessary for evaluation. It may now be ascertained for starters that the pumps pu1-pu10 have no influence on the sensor S11 whatsoever and thus on the consumer V6. Vice versa the pump pu11 has no influence at all on the consumers V1-V5 from which it results that it hereby must be the case of two installation parts which are independent of one another, wherein pump pu11 evidently only supplies the consumer V6.

With the remaining installation part, which includes the pumps pu1-pu10, firstly one examines which pumps are arranged in pump groups, i.e., which pumps are connected into a group in parallel or series. The pumps which on the consumer side cause the same hydraulic changes with a change of their rotational speed, are connected into groups. This, as is to be deduced from the matrix according to FIG. 7*b*, is the case for the pumps pu8 and pu9, for the pumps pu1 and pu2 as well as for the pumps pu4 and pu5. These pumps are thus identified as groups and one thus should yet determine whether these in each case are connected in series or in parallel, which is described further below.

One then determines which pumps, with a change of rotational speed, influence only one consumer or only one consumer group according to the rotation speed change, i.e., with an increase in rotational speed influence in a pressure increasing manner and with a rotational speed reduction in a pressure-reducing manner. Since, with the embodiment example which is represented by way of FIG. 7, one has assumed that the pumps in method step b are activated with an increased rotational speed compared to the previous lower constant rotational speed, it results that they only have one positive 1 in the row. It is the pumps pu1, pu2, pu3, pu6, pu7 pu10 and of course pu11 which belong to the other installation part. These pumps are directly assigned to a consumer, i.e. they supply the consumer without intermediate connection of further pumps.

However, one may not only ascertain by way of these assignments as to which pumps are directly assigned to a consumer, but moreover which consumers are supplied by which pumps at all. Thus it is evident that the pump pu10 only affects the consumer V5 and this in a direct manner. With regard to the pump group pu8 and pu9, one may recognise that these influence the sensors S1, S3, S6 and S7 in the same direction, i.e., that with an activation of the pump with an increased rotational speed, a higher pressure drop at these sensors, i.e., an increasing pressure change is given. This says that the pumps pu8 and pu9 feed the consumers V1-V4 but only indirectly, i.e., that yet other pumps need to be intermediately connected. With regard to the pumps pu4 and pu5, one may ascertain in the same manner that they supply the consumers S1 and S3, but however likewise only in an indirect manner, since the consumers V3 and V4 are directly supplied by the pumps pu6 and pu7 respectively, and since the pumps pu4 and pu5 as a pump group however do not influence these consumers in the same direction, it results that the pump group pu4 and pu5 as well as the pump pu6 and the pump pu7 are connected in parallel, wherein the pumps pu6 and pu7 in each case are assigned to the associated consumers V3 and V4, whereas the pump group pu4 and pu5 affect the consumers V1 and V2, but likewise not in a direct manner.

Inasmuch as this is concerned, one merely yet needs to determine how the pump groups are connected. These three groups of pumps pu8 and PU9, pu4 and pu5 as well as pu1 and pu2 therefore need to be examined further as far as this is concerned. However further sensors are required for this, which detect the differential pressure of the respective pumps of the pump group or the throughput. With the embodiments according to FIGS. 8 and 9, the differential pressure sensors are applied parallel to the pump, whereas with the embodiments according to the FIGS. 10 and 11, volume flow sensors or so-called throughput meters are assigned to the pumps. Irrespective of which sensors are applied, again the previously described method is applied for determining the arrangement of the pumps in a pump group, i.e., the pumps are firstly represented as by way of FIGS. 10 and 11, operated with a constant rotational speed, whereupon a pump, here the pump pu1, is activated with an increased rotational speed. By way of the changing volume flow of this and of the other pumps, one may now determine whether the pumps arranged into a pump group are connected in series or in parallel. With a parallel connection according to FIG. 10*a*, with an activation of a pump, here pump the PU1 with an increased rotational speed ω1 of this pump, an increased throughput q1 results, whereas the other two pumps pu2 and pu3 continue to run with the previous constant rotational speed, but have a reduced flow volume rate q2 and q3 respectively. It directly results from this, that the pumps must be connected in parallel, since otherwise the delivery rates would have to increase as is illustrated by way of FIG. 11, where three pumps pu1 to pu3 are connected in series. If here the pump pu1 is activated with an increased rotational speed ω1, an increased throughput quantity q1, q2 and q3 of all three pumps thus results, despite a constant rotational speed of the pumps pu2 and pu3.

If the arrangement of the pumps are to be determined by way of pressure sensors thus differential pressure sensors parallel to the pump, then one of the pumps of a pump group after all have been activated for producing a constant pressure, activates one of the pumps for producing this increased pressure. This is effected with the examples according to FIG. 8 and FIG. 9 in each case with the pump pu1. One may deduce from FIG. 8*b* as to the temporal course of the change of the hydraulic variables. After the pressure jump of the pump pu1, the pressure at the pumps pu2, pu3 and pu4 remains practically unchanged, wherein the rotational speeds of the pumps pu2 and pu3 reduce with a slightly increasing pressure, which may be deduced as a parallel connection, whereas the rotational speed of the pump pu4 with a constant pressure increases, which indicates that this pump does not belong to the pumps connected in parallel. Analogously, with the series connection of the pumps pu1, pu2 and pu3 into a group, a pressure change only at the pump pu1 and with all other pumps merely a rotation speed change and specifically in an increasing manner, results.

As the above explanations illustrate, thus the circuit diagram according to FIG. 7*a* may be completely determined. Since with the previously described method, a sensor is assigned to only each consumer or each consumer group, the separate sensor must be applied on the part of the pump in the pump groups for determining the arrangement of the pumps.

Inasmuch as this is concerned, it is often more favorable to design the method according to an embodiment of the invention exclusively with pump-side pressure sensors, differential pressure sensors and throughput sensors, as this is represented by way of the FIGS. 12-14. This method take its course in the same manner, i.e., firstly in a first method step, all pumps are activated with a constant rotation speed and then in a second method step subsequently all pumps are activated individually and one after the other with a rotational speed which is changed with respect to this, typically an increased rotational speed. The resulting changes are recorded in a matrix, as is represented by way of FIG. 13 for the throughput measurement of the pumps and by way of FIG. 14 for the differential pressure measurement at the pumps. Thereby, the matrix is formed in the same manner as that described by way of FIG. 7*b*, i.e., 0 stands for no change of the hydraulic variable of the respective sensor on activating the respective pump with an increased rotational speed, 1 for an increasing change and −1 for a reducing change.

For the evaluation of the matrix according to FIG. 13, it is however necessary to previously sort this according to rows. With the detection of the volume flow changes as are drawn in FIG. 13, the sorting of the rows is effected according to the number of increasing changes from the top to bottom. Thus the uppermost row concerning pump pu7 has one 1, specifically at q11. The row pu10 arranged therebelow also has only one 1, specifically at q10. The rows pu7 and pu6 in each case have three increasing changes, the rows pu1, pu2 and pu3 in each case five increasing changes, the rows pu4 and pu5 seven increasing changes and the rows pu8 and pu9 eight increasing changes. The rows are sorted in an increasing manner from the top to bottom according to this sequence. Thereby, a pump is assigned to each row and the sensor assigned to the pump in each case is assigned to each column. The columns are sorted in an increasing manner in the same manner as the pumps, but from the left to the right, so that a mirror-symmetry of the matrix with respect to a diagonal D, which is formed by the fields which relate to the same pumps, results. This diagonal extends from the top left to the bottom right in the matrix beginning from the field pu11, q11 to the field pu9, q9.

The functional relationship, i.e., the construction of the installation may be directly evaluated by way of this matrix. Thus firstly in the same manner as with the first embodiment example, by way of the zeros in the first column below the diagonal or in the first row above the diagonal, one may ascertain that the pumps pu1-pu10 belong to a different installation part than the pump pu11, since this pump only influences its own sensor q11.

By way of the number of increasing changes, thus the numbers 1 of the throughput in each gap below the diagonal D or in each row above the diagonal D which divides the matrix, it results as to which pumps are hydraulically connected in parallel and which are hydraulically connected in series. An equal number as occurs for example in the columns q7 and q6 and q5 in FIG. 13 below the diagonal D, indicates that these pumps are arranged in parallel, whereas a number differing with respect to this, such as for example at q4—here it is three—indicates that this pump pu5 does not lie in parallel but in series with one of the previously mentioned pumps. As to how the arrangement is given results from the number of increasing changes. Thereby, the number of increasing changes of the hydraulic variables in the columns below the diagonals or, since it is mirror-symmetrical, in the rows above the diagonal of the matrix, indicates the number of the pumps which are hydraulically connected in series upstream of the respective pump. Thus for example the pump pu1 to which the sensor q1 is assigned, is characterised by four ones in the column q1 below the diagonal, i.e. four increasing changes of the hydraulic variables, which means that four pumps are connected in series upstream of the pump pu1. This may thus be determined for each of the pumps.

Moreover, one may ascertain which of the pumps are directly assigned to a consumer or to a consumer group, and here it is specifically the case of the pumps with which no increasing change of the hydraulic variables in a row below the diagonal or a column above the diagonal of the matrix is plotted. This for example applies to the pump pu7, in whose associated row in FIG. 13 below the diagonal there are only the numerals 0 and −1, in the same manner for pu6 there are the numerals 0, −1, −1, etc. Thus one may ascertain by way of these details as to how many pumps are connected in series upstream of the respective pump and which pumps connect directly to a consumer or consumer group. Thus the circuit arrangement according to FIG. 12 is unambiguously defined.

Moreover, in FIG. 13, one may determine which pumps are connected hydraulically in parallel and which in series by way of the number of increasing changes of the hydraulic variable in each row below, or in each column above the diagonal D of the matrix. The number of increasing changes (+1) thereby indicates the number of pumps which are hydraulically connected in series downstream of this pump. Thus in FIG. 13, the pump PU8 in the row has seven ones below the diagonal D, which means seven pumps are connected in series downstream of this pump. Thereby, it is the case of the pumps pu1 to pu7. If one reads the row below the diagonal D in FIG. 13 under pu4 then three ones result, i.e. three pumps connected in series downstream. Thereby, it is the case of the pumps pu1 to pu3 as the circuit diagram according to FIG. 12 illustrates.

In an analogous manner, the evaluation of the matrix according to FIG. 14, with which instead of throughput changes q, the pressure changes s are specified. However, here it is not the increasing changes 1, but the reducing changes −1 which are used for evaluation, but otherwise the evaluation is effected the same manner as described by way of FIG. 13.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for energy-optimization on operation of several speed-controllable centrifugal pumps in a hydraulic installation, the method comprising:

determining which pumps as pilot pumps are directly assigned to a consumer and which pumps are subordinate to the pilot pumps; and activating the subordinate pumps with varying rotational speeds for energy-optimization, wherein an energy-optimization circuit is optimized by way of a variable e being determined for each pump, said variable being determined by the quotient of a change of taken-up power and a change of delivered hydraulic power of the pump, and that the variables e of the pilot pumps are added and thus brought to agree with the variable e of each of the pumps connected in series upstream, by way of variance of the activation of the pumps connected in series upstream, wherein parallel-connected pumps which are connected upstream in series are considered as one pump.

2. A method according to claim 1, wherein the electrical uptake power P of the drive motor is used as the taken-up power.

3. A method according to claim 2, wherein a delivery head h of the pump is used as a measure for the delivered hydraulic power.

4. A method according to claim 3, wherein a delivery quantity q of the pump is used as a measure of the delivered hydraulic power.

5. A method according to claim 4, wherein pumps connected in parallel are activated such that a variable $e_q$ of the pumps connected in parallel is equally large, wherein the variable $e_q$ is formed by the quotient of the change of taken-up power P and the change of the delivery quantity q of the pump.

6. A method according to claim 3, wherein pumps connected in parallel are considered as one pump and with which a variable $e_h$ for this one pump is formed by the addition of the quotients of the change of taken-up power P and the change of the delivery head h of each of the pumps connected in parallel.

7. A method according to claim 3, wherein, for energy-optimization, a variable $e_h$ of each of the pumps connected in series is used, which is formed by the quotient of the change of taken-up power P and the change of the delivery head h of the pump.

8. A method for energy-optimization on operation of several speed-controllable centrifugal pumps in a hydraulic installation, the method comprising:

determining which pumps as pilot pumps are directly assigned to a consumer and which pumps are subordinate to the pilot pumps; and activating the subordinate pumps with varying rotational speeds for energy-optimization, wherein each pump comprises an electric motor and with a centrifugal pump driven thereby, with an electronic speed controller with control electronics, with which the control electronics produces a signal, which represents a variable e which is determined by a quotient of a change of taken-up power P and a change of a hydraulic output variable or a variable of the pump which is influenced thereby.

9. A pump according to claim 8, wherein the hydraulic output variable for determining a variable $e_h$ is a delivery head h of the pump.

10. A pump according to claim 8, wherein the hydraulic output variable for determining a variable $e_q$ is a delivery rate q of the pump.

11. A pump according to claim 8, wherein the control electronics produce a signal S which represents power saturation.

12. A pump according to claim 8, wherein a digital control and regulation unit is provided.

* * * * *